US005163569A

United States Patent [19]

Buff

[11] Patent Number: 5,163,569

[45] Date of Patent: Nov. 17, 1992

[54] STAND FOR FLEXIBLE BAGS

[76] Inventor: Jonathan A. Buff, 306 Highgate Dr., Slingerlands, N.Y. 12159

[21] Appl. No.: 498,087

[22] Filed: Mar. 22, 1990

[51] Int. Cl.[5] ..... A47B 43/00

[52] U.S. Cl. ..... 211/201; 211/12; 211/195

[58] Field of Search ..... 211/195, 12, 201, 181, 211/202, 182, 200, 85, 198, 71; 312/189, 111, 258, 265.5; 52/70, 71; 160/377, 135; 229/120.31, 120.36, 120.37

[56] References Cited

U.S. PATENT DOCUMENTS 2,680,501 6/1954 Cunningham ..... 229/120.36 X
3,113,400 12/1963 Emond ..... 211/181 X
3,371,840 3/1968 Schlager et al. ..... 229/120.36 X
3,511,404 5/1970 Pearson ..... 229/120.31 X
4,082,389 4/1978 Stewart ..... 312/258
4,189,056 2/1980 Majewski ..... 211/195
4,795,083 1/1989 Johnske ..... 229/120.36

*Primary Examiner*—Blair M. Johnson
*Assistant Examiner*—Korie H. Chan

[57] ABSTRACT

A collapsible support structure for receiving flexible grocery bags. The structure includes a locking mechanism which positively locks it in the open position and which semi-locks it in the closed position. The entire structure is composed of only two sizes of plastic panels.

13 Claims, 3 Drawing Sheets

STAND FOR FLEXIBLE BAGS

FIELD OF THE INVENTION

The instant invention is in the field of support structures. More particularly, it is in the field of collapsible support structures for supporting unstable, sack-like containers.

BACKGROUND OF THE INVENTION

For many years, supermarkets packed one's purchased groceries in paper bags. These bags were commonly made of medium to heavy weight brown paper and had a flat bottom. Once properly packed, these bags could be easilY carried, and if placed upright on a flat surface, remain stable in this upright position. The bag's stability in the upright position greatly facilitated transporting of filled bags that were placed within a car's trunk or on a car's floor or seat.

In an effort to reduce costs and to make the bag easier to carry, supermarkets now commonly use a specially designed plastic bag for the bagging of groceries. The bag includes a pair of shaped handle portions at its top and a semi-flat bottom. To carry a bag of this type, one merely has to place one's fingers through the handles and lift. The old style paper bags required bottom support during carrying.

However, the new type of bags do suffer one great drawback. When packed with groceries and placed on a flat surface, the bag is unstable in its upright position. The user often has to lodge the bag in place either during or after positioning it within a car. Without external support, the bag falls over during a car's turning or braking movements. Due to this inconvenience, many consumers request the supermarket to bag their groceries in the old-style paper bags. This increases the supermarket's costs and forces the consumer to use a bag that is more awkward to carry.

SUMMARY OF THE INVENTION

The invention is a foldable support structure with internal segregated compartments. The structure may be locked in an opened position or folded into a semi-locked, closed position. Once opened, the structure includes four internal compartments and each compartment is sized and configured to stably support a plastic grocery bag in an upright position.

The structure does not include a top or bottom and can be collapsed into a flat configuration that has a thickness approximately equal to five times its side wall thickness. Once collapsed, the structure assumes a shape similar to a flat package and can be easily stored.

A plurality of interfitting panels make up the basic components of the support structure. Only two sizes of panels are used and the panels are preferably made of an injection molded plastic material. As the structure is opened or closed, each of the smaller of the panels rotates about its ends. While this movement is taking place, the larger panels remain parallel and move closer together.

At the ends of each small panel are located a series of spaced hook members. Each hook member includes two prongs which extend perpendicularly to the body of the panel. These hook members are designed to engage rod members that are located on the ends of the large panels Adjacent to the rod members are a plurality of apertures through which a portion of each of the hook members may extend.

Each large panel also includes a rod member in its center to which at least one of the small panels is affixed in the previously noted manner. However, the center rod member is unlike the other rod members in that it has a "D"-shaped cross-section The unique shape of the center rod member interacts with the shape of the hook members to produce a positive locking action when the structure is placed in its open position. When the structure is fully closed, the hook members engage the center rod member in a semi-locking manner The structure is preferably composed of 6 small panels and 3 large panels. Each panel is approximately thirteen inches high. The small panels are 8 inches long and the large panels are 26 inches long. When fully assembled and in an open condition, the unit includes four compartments that are approximately 8 inches wide, 13 inches long and 13 inches high. When using panels that are approximately one-half inch thick, the unit once collapsed has a thickness approximately equal to five times the individual wall thickness i.e.—two and a half inches.

The support structure can be easily stored in a car trunk since it requires only a small space once it is in its collapsed configuration. When needed, it can be opened and used to stably support four grocery bags.

Therefore, the instant invention solves a major problem encountered when using plastic bags. In addition, it can also be used to stably support paper bags or other articles which the user desires to transport in a stable manner.

DETAILED DESCRIPTION OF THE DRAWINGS

The invention is a collapsible support structure that can be placed on a flat surface. The structure includes a number of interior compartments with each compartment sized to receive a filled flexible bag of the type commonly used by supermarkets for the bagging of purchased groceries.

Figure 1:
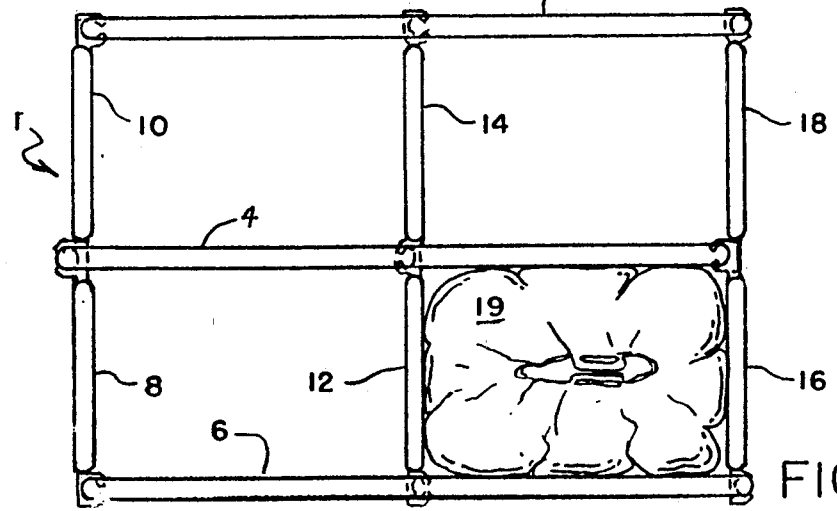
FIG. 1 is a plan view of the invention in an unfolded or open condition.

FIG. 1 is a plan or top view of the invention in a fully open, locked position. The support structure 1 comprises three large first type panel members 2, 4, and 6 connected to each other by six smaller second type panel members 8, 10, 12, 14, 16 and 18. A first type panel member includes an interior connecting feature whereas the second type panel optionally includes an interior connecting feature. As shown, the interior of the structure is segregated into four equal volume compartments. Within one of the compartments can be seen a filled flexible bag 19.

Figure 3:
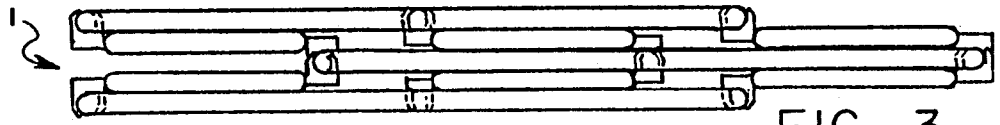
FIG. 3 is a plan view of the invention in a folded or collapsed condition.
Figure 2:
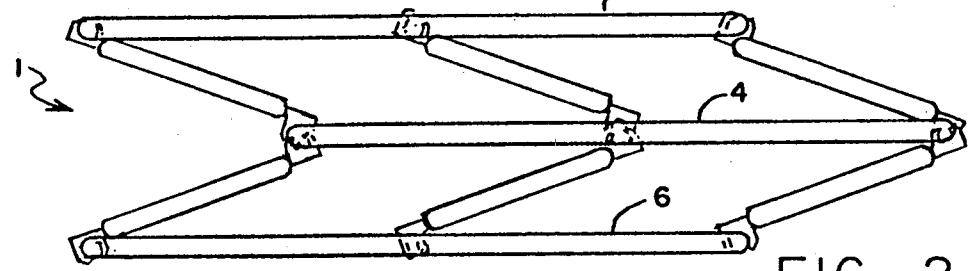
FIG. 2 is a plan view of the invention in a semi-folded condition.

FIG. 2 shows the support structure in a transitory open position between the fully open, locked position shown in FIG. 1 and a closed, semi-locked position shown in FIG. 3. In this figure, the compartment that was previously shown housing a bag is now empty. As can be seen, as one collapses the support structure, its length increases as its width decreases.

FIG. 3 shows the structure in its fully collapsed condition. In this state, it can be easily stored without requiring a significant amount of space. As can be seen, it's width in the collapsed state is approximately equal to five times the thickness of any one ot the component panels.

Figure 4:
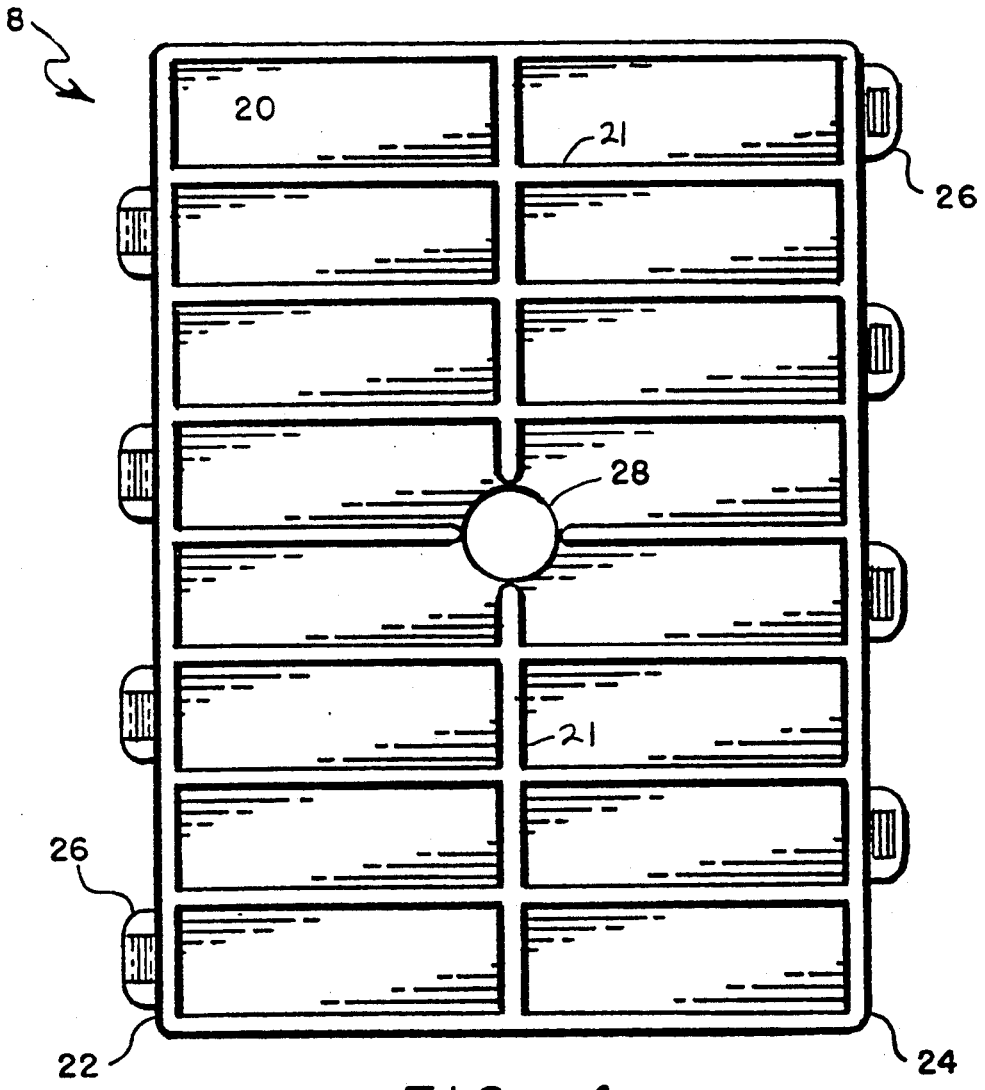
FIG. 4 is a front view of a first, small sized panel.

FIG. 4 is a front or elevation view of panel 8 which is one of the smaller size panels. It is pointed out that this panel is identical to panels 10, 12, 14, 16 and 18.

Figure 5:
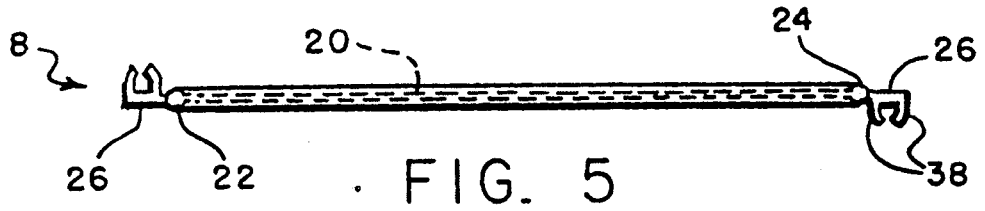
FIG. 5 is a plan view of the panel of FIG. 4.

FIG. 5 shows a plan view of the same panel. Using FIGS. 4 and 5, it can be seen that the panel body 20 is planar and preferably includes a plurality of ribs 21 to increase its strength. As an alternative embodiment not shown, the panel can simply consist of a grid like mesh of plastic or metal rods positioned similarly to the depicted rib network.

As can also be seen in FIGS. 4 and 5, the panel has two side edges, 22 and 24. On each edge are located four spacedly separated hook members 26. Each hook member includes a pair of prong members 38. From FIG. 5, one can see that the hooks on one edge all face in one direction and the hooks on the other edge all face in the opposite direction.

It should also be noted in FIG. 4 that the hooks along each edge are spaced from each other by a distance greater than the vertical height of a single hook. In addition, each hook on an edge is aligned with a space on the other edge. The spacing, location and orientation of the hooks allow one small panel to be adjacent to another small panel without interference.

To facilitate handling of the structure, each small panel includes a center finger hole 28. The inclusion of a center hole also facilitates opening or closing of the support structure.

Figure 6:
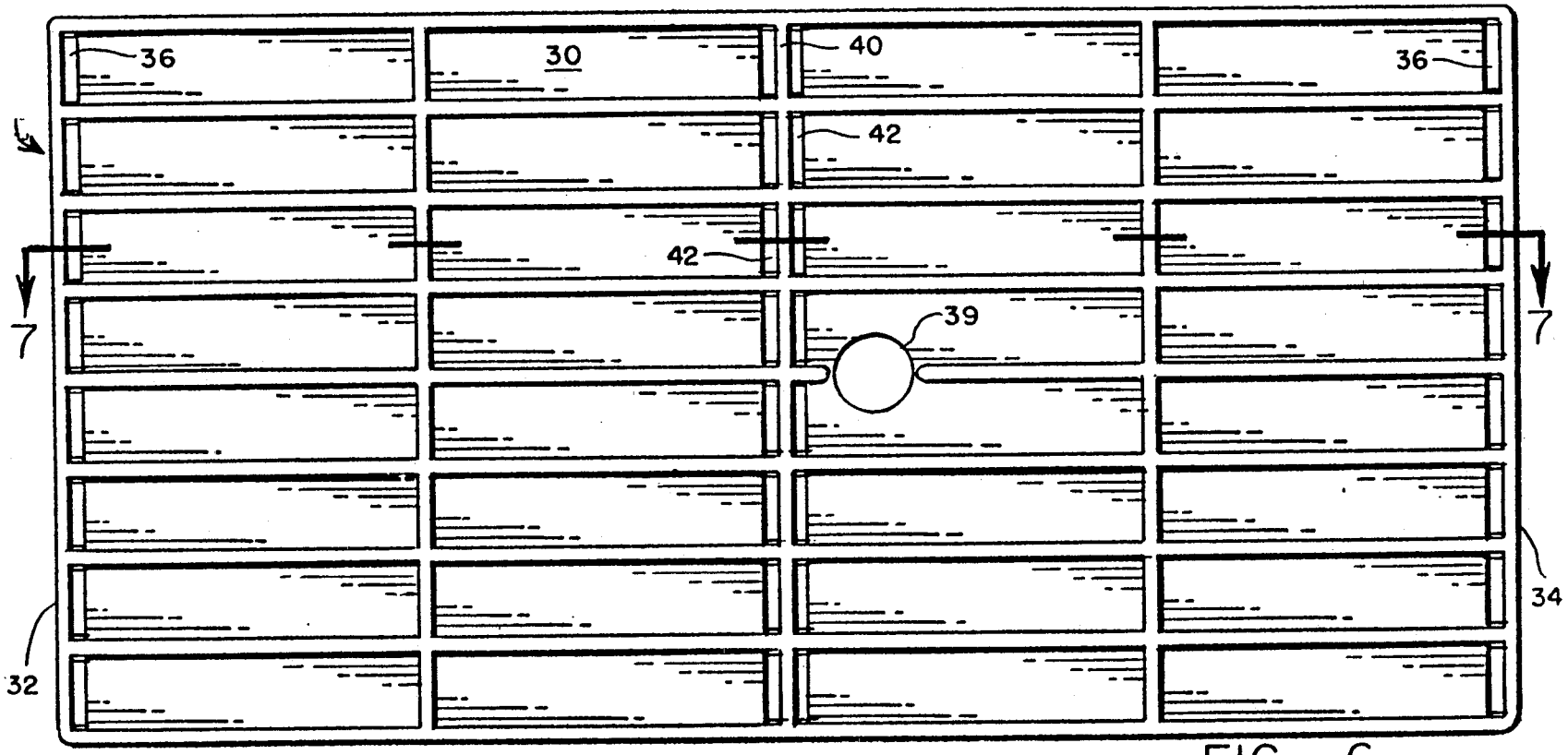
FIG. 6 is a front view of a second, large-sized panel.
Figure 7:
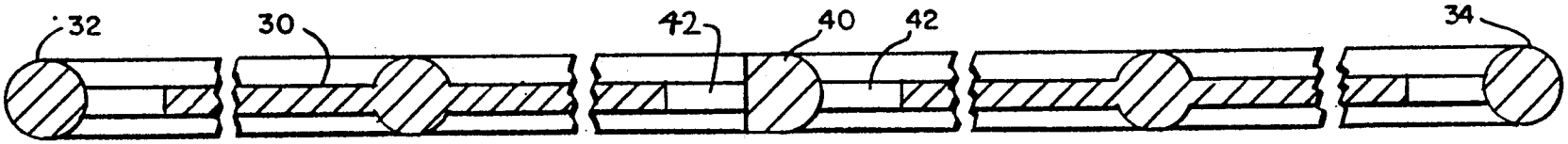
FIG. 7 is a cross-sectional view of the panel of FIG. 6.

FIG. 6 depicts large panel 2. The panel shown is identical to either of the other large panels 4 or 6. FIG. 7 is a cross-sectional view of the panel of FIG. 6.

The panel is composed of a planar body portion 30 and side edge portions 32 and 34. The two edges or edge portions are rod-like and adjacent to each edge portion are a plurality of vertically extending apertures 36. The apertures have a greater width than that of the prongs 38 of hook members 26 (seen in FIGs. 4 and 5). Preferably, the aperture width is at least twice the width of a prong 38. The panel includes a plurality of strengthening ribs similar to the small panel ribs 21. Each panel has a center hole 39 which is used in a similar manner to the center hole 28 located in each of the small panels.

The panel has an additional vertical rod member 40 located proximate its longitudinal midpoint. Along both sides of the vertical rod are a series of vertically spaced apertures 42 similar in size to the side apertures 36.

The edge rods 32 and 34 are circular in cross-section. When one of the small panel hook members 26 is connected to a portion of either rod 32 and 34, the hook member partially encircles the rod. This is the method used to connect the small panels to the large panels and is the preferred embodiment of a first connecting means used to attach the end of one panel to the end of another panel. This can be easily seen in FIGS. 1–3. The apertures are sized to allow a ninety degree rotation of a hook member about the rod adjacent the aperture.

The center rod 40 of each of the large panels is dissimilar in cross-section to the side rods (32,34). As can be seen in FIGS. 7–10, it has a cross-sectional shape similar to a letter"D" with flattened top and bottom portions. The purpose of this shape is to provide the structure with a positive locking action when the structure is in a fully open configuration and a semi-locking action when the structure is in a collapsed condition.

Figure 8:
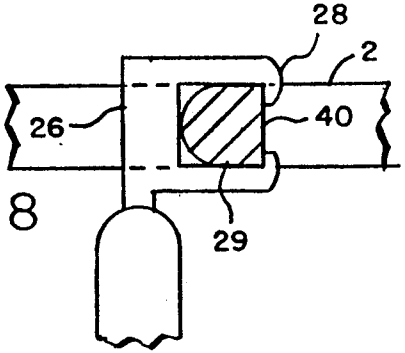
FIG. 8 is a plan view of a hook member in locked engagement with a rod member.

FIG. 8 shows a small panel hook member 26 partially encircling the center rod 40 of large panel 2. This attachment is the preferred embodiment of a second connecting means that is used for attaching an end of one panel to an interior portion of another panel. This view is of a hook/rod arrangement positioned as shown in FIG. 1. The top and bottom flats of the "D" are in line with the prong flats 29 and thereby provide a positive locking action. The top of the hook member is located in one of the apertures 42. At this point, the structure is stable since a moderate force would be required to spread the hook prongs in order to begin the collapsing process.

Figure 9:
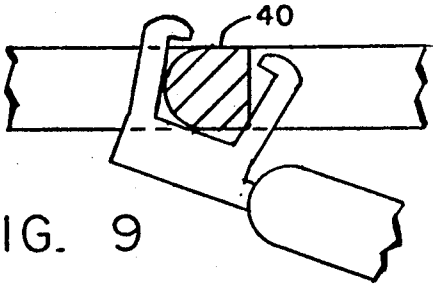
FIG. 9 is a plan view of a hook member in a transition engagement with a rod member.

When one starts to collapse the structure, the prongs spread as the hook rotates about the rod. FIG. 9 is a depiction of the hook/rod arrangement shown in FIG. 2. At this point, there is no locking between the rod and hook. As can also be seen in this view, each of the hook member prongs is located in a different one of apertures 42.

Figure 10:
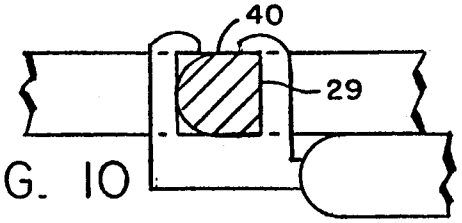
FIG. 10 is a plan view of a hook member in a semi-locked engagement with a rod member.

FIG. 10 shows a hook/rod arrangement that would result when the structure is in the fully closed position depicted in FIG. 3. A flat side of the rod is adjacent to only one of the prong flats 29 and thereby provides a semi-locking action. At this point, a small amount of force would be required to initially spread the hook prongs. This creates a stable collapsed condition of the structure.

In operation, the device would be fully assembled and initially in its folded or oollapsed state and stored in the vehicle. When the user decides to open the structure for subsequent use, the device would be placed in its upright position. At this point, a top view of the device would be provided by the plan view of FIG. 3.

Next, one would put a finger of one hand into the finger hole 39 of panel 2. The user would then put a finger of the other hand into finger hole 39 of panel 6. Then, the user would apply outward pressure on the panels by spreading his or her hands apart. Some initial force would be required to start spreading the hook prongs to overcome the semi-locked position. Then, the device would easily open to the FIG. 2 position quickly followed by the position shown in FIG. 1. At this point, the prongs would spring back to their initial unbent configuration and positively lock the structure in its open position. The device would now be ready to receive and stably support four flexible bags that are filled with groceries or the like.

Once the bags have been removed, the user would collapse the device by holding the top of one of the outer panels (2 or 6) and applying a moderate force to one edge (32 or 34) of center panel 4. This would cause the unit to collapse as shown.

It should be noted that the structure can be simply modified to increase or decrease the number of interior compartments by increasing or decreasing the number of interior small panels. Increasing the number of compartments would involve increasing the number of vertical rods located in the large panels and attaching additional small panels to the additional rods by the method previously described. A structure with only two compartments can be fashioned by removing panels 4, 8, 12 and 16.

The embodiments disclosed herein have been discussed for the purpose of familiarizing the reacer with rne novel aspects of the invention. Although a preferred embodiment of the invention has been shown and described, many changes modifications and substitutions may be made by one having ordinary skill in the art without necessarily departing from the spirit and scope of the invention.

I claim:

1. A collapsible support structure comprising:

a plurality of first type panel members wherein each first type panel member has a top edge, a bottom edge and two outer side free edges each extending from said top edge to said bottom edge of said first type panel members;

a plurality of second type panel members wherein each second type panel member has a top edge, a bottom edge and two outer side free edges each extending from said top edge to said bottom edge of said second type panel member;

first connecting means located on said outer side free edges of said first and second types of panel members for removably interconnecting the outer side free edges of at least two of said first type panel members to the outer side free edges of at least two of said second type panel members wherein said first conneting means allows a pivotal motion between connected panels;

second connecting means located on a middle portion of at least two of said first type panel members which removably connect said middle portions to a complementary connecting means located proximate the outer side free edges of at least one of said second type panel members wherein said second connecting means allows a pivotal motion between connected panels; and wherein said support structure, when assembled, includes at least two inerior segregated volumes each having open top and bottom ends.

2. The structure of claim 1 wherein said first connecting means comprises a hook means on one of either said first or second type panel members and a rod-like hook receiving means on the other of said first or second type panel members.

3. The structure of claim 2 wherein said second connecting means comprises a rod-like hook receiving means that has at least two substantially flat surfaces for providing, while in engagement with a complementary hook means located on a second type panel member, a positive locking action when said structure is in a fully open position.

4. The structure of claim 1 wherein said second connecting means includes locking means for positively and releasably locking said structure in an open position.

5. The structure of claim 2 wherein three first type panel members are connected to six second type panel members to form a structure that includes four interior segregated volumes that have open top and bottom ends.

6. A collapsible support structure for supporting a plurality of plastic grocery bags in an upright position, said structure comprising:

a plurality of first type panel members, said first type panel members having a planar body and first and second edges located on opposite ends of said body;

a plurality of second type panel members, said second type panel members having a planar body and first and second edges located on opposite ends of said body;

a plurality of hook means located on said first and second edges of either said first or second type panel members;

a plurality of first hook receiving means located on said first and second edges of the other of said first or second type panel members;

a plurality of second hook receiving means on at least two of said first type panel members, wherein said second hook receiving means is located between said first and second edges of said first type panel member;

wherein said first and second type panel members cna be pivotally interconnected to form said support structure by connecting said hook means to said first and second hook receiving means; and wherein said second hook receiving means includes means for releasably locking at least one of said hook means in at least one position.

7. The structure of claim 6 wherein the structure in its open position includes at least four interior segregated volumes each sized to receive a flexible grocery bag.

8. The structure of claim 6 wherein said second hook receiving means is a rod having a flattened "D" shape.

9. The structure of claim 6 wherein on a panel member that has hook means located on is first and second edges, there is located between each of said hook means on said first edge a gap and the hook means on said second edge are aligned with the gaps on said first edge.

10. The structure of claim 6 wherein said panels form the sides of the structure and the structure is open on its top and bottom.

11. A collapsible support structure comprising:

a plurality of first type panels;

a plurality of second type panels pivotally connected to said first type panels by a first connecting means located proximate an edge portion of each of said first and second type panels; and at least one of said second type panels is pivotally connected to an interior point of at least two of said first type panels by a second connecting means that comprises a rod having a "D" shaped cross-section located on either one of said first or second type panel members and a complimentary hook member located on either one of said first or second type panel members for pivotal connection with said rod whereby said structure, when in an open condition, contains at least two segregated compartments and wherein said pivotal connections allow the structure to be collapsed into a closed condition.

12. The structure of claim 11 wherein six of said second type panels are attached to three of said first type panels to form a structure having four interior segregated compartments.

13. The structure of claim 11 further comprising a plurality of vertically oriented apertures adjacent said rod.

* * * * *